United States Patent [19]

Nuttin

[11] Patent Number: 4,611,799

[45] Date of Patent: Sep. 16, 1986

[54] PROCESS AND INSTALLATION FOR THE PRODUCTION OF DOCUMENTATION

[76] Inventor: Pierre Nuttin, 1289 Chaussée de Wavre, 1160 Brussels, Belgium

[21] Appl. No.: 227,259

[22] Filed: Jan. 22, 1981

Related U.S. Application Data

[63] Continuation of Ser. No. 12,759, Feb. 16, 1979, abandoned.

[51] Int. Cl.[4] ..... B65H 41/00; B31B 1/26

[52] U.S. Cl. ..... 270/52.5; 493/410; 493/411

[58] Field of Search ..... 270/52.5, 37, 53, 39; 493/410–411; 101/228

[56] References Cited

U.S. PATENT DOCUMENTS

| | | | |
|---|---|---|---|
| 2,991,950 | 7/1961 | Axon | 242/187 |
| 3,596,899 | 8/1971 | Fulk | 270/52.5 |
| 3,701,522 | 10/1972 | Chi | 493/399 X |
| 3,829,080 | 8/1974 | Braen | 493/28 X |
| 3,897,727 | 8/1975 | Fulk | 270/18 X |
| 3,899,381 | 8/1975 | O'Brien | 270/37 X |
| 4,018,431 | 4/1977 | Schueler | 270/52.5 |

*Primary Examiner*—A. J. Heinz

*Attorney, Agent, or Firm*—Finnegan, Henderson, Farabow, Garrett & Dunner

[57] ABSTRACT

A modular system and process for continuously producing business forms from a web of flexible material formed on a roll. The system utilizes a plurality of independent modular units through which a continuous web of flexible material, such as paper, is processed. The modular units can be positioned in a variety of desired arrangements to enable the user to take a roll of paper and process it to a final printed and processed form. The roll of paper is supported and controllably unwound by an independent first modular unit as it is required, and the rate of supply of material from one unit to the next is controlled by monitoring the loop of material extending between any two successive units.

10 Claims, 18 Drawing Figures

PROCESS AND INSTALLATION FOR THE PRODUCTION OF DOCUMENTATION

This is a continuation of application Ser. No. 12,759, filed 2/16/79, now abandoned.

FIELD OF THE INVENTION

The invention concerns the production of documentation.

BACKGROUND OF THE INVENTION

In the information field, the paper for use with a computer print out device is commonly pre-printed and folded (typically in a zig-zag manner) using conventional printing and folding machines. The zig-zag stacks of forms are supplied to the users to enable them to keep their printing stock magazines stocked and, depending on the format and capacity of the printer machine, each stack may typically have between 750 and 2000 folds.

Thus, information retrieval systems and computer print out terminals have to depend on conventional printing facilities, with the inevitable waste of time as each new stack of forms is loaded into magazines. With high speed printers each packet can be relatively quickly used up, so that to the aforementioned time loss must be added the time lost whenever the paper becomes trapped, as frequently happens, as it is unfolded ready to be printed on by the printer.

THE INVENTION

The invention is aimed at eliminating these aforementioned inconveniences and weaknesses by producing printed documents directly and continuously on the spot from a roll of blank paper, these documents being directly capable of subsequent processing by the printer with no additional handling. In this way the problems and time delays associated with the conventional methods of supply of such documents are largely eliminated.

The invention broadly is applicable to any process in which the medium to be printed on or otherwise processed is an elongated run of a flexible and deformable processing-carrier material which can be rolled up onto a reel. However, since it initially is applicable to paper as the flexible and deformable processing-carrier material, the invention initially is explained in relation to its application to unwinding of an elongated run of paper from a roll held on a supporting reel and followed by printing, only by way of illustration. The invention is similarly applicable to an elongated run of any other flexible and deformable processing-carrier material.

According to one feature of the invention, the process for continuously producing printed documents from a roll of an elongated run of flexible, processing-carrier material such as blank paper stored on a reel, includes the steps of (i) mounting the reel bearing the roll of paper in an independent primary unit which is adapted to unwind the roll of paper, which primary unit is located in the immediate proximity of at least one independent secondary unit which is adapted to process and/or print on the paper which has been unwound by the primary unit; (ii) forming a loop of the paper between the two units, (iii) automatically regulating the device which causes the unwinding of the reel in relation to the height of the low point formed by the loop of paper between the two units; and (iv) continuously producing documents by the second unit.

The movement of the paper may be regulated by a printer.

According to another feature of the invention, the process provides for an intermediate treatment step between the unwinding by the primary unit and the printing and/or processing by the second unit, which intermediate processing step is performed in an independent unit and serves to change the physical appearance of the paper, for example, as by forming a transverse perforation, or holes, or trimming the edges, and/or to print out the paper or fold and assemble the paper.

According to still another feature of the invention, and in a case where there are several independent units in succession, working on the paper drawn from the roll and linked together by the paper alone, the process provides a loop of paper between successive units, and the movement of the paper between each two units is controlled in relation to the lowest point of the loop of paper between them with reference to a predetermined level.

Thus, in accordance with the process of the invention, units which work continuously on the paper run are independent of each other, the only link between them being the length of unwound paper as it passes in succession from one unit to another.

The invention also resides in an installation for the operation of its process, with the object of continuous production of documents for a printer, which installation comprises at least one unwinding unit for holding and unwinding a roll of paper, at least one independent second unit for the processing of, and/or printing onto, the paper situated in the immediate proximity of the unwinding unit so that paper unwound from the first unit can extend to the second unit with a loop in the paper between the two units, and a device for monitoring the position of the said loop to control the unwinding of the roll by the first unit depending on the requirements of the second unit as determined by the position of the said loop.

According to another feature of the invention, the device for monitoring the position of the paper loop is an optical device comprising (i) a photo-electric cell which is carried by the first unit and is connected to a control system which controls the unwinding of the roll, and (ii) a light-source which produces a beam of light which is intercepted by the loop of paper between the two units so as to control the unwinding of the reel by the intermediacy of the photo-electric cell.

According to still another feature of the invention, the installation for the continuous treatment of the paper run includes several independent units to which the paper is fed in succession, with a loop of paper between each two adjacent units, and a monitoring device is associated with each loop for controlling the rate of supply of paper from one unit to the next.

Since the different units do not have to be connected to each other, it is possible to place several units between a primary unit (for unwinding the paper roll) and the final printer (as well as other units after the printer unit), so as to form any particular production line, which can easily be modified by adding or subtracting intermediate units as appropriate.

The invention will now be described by way of example, but without limitation, with reference to the accompanying drawings.

IN THE DRAWINGS

DETAILED DESCRIPTION OF THE DRAWINGS

The respective independent units which enable the process of the invention to be operated are described first. Different combinations of these units forming different production lines for the continuous production of documents will then be described. However, it is understood that these examples are intended merely to demonstrate some aspects of the invention and that the invention is not limited to these particular examples.

Figure 1:
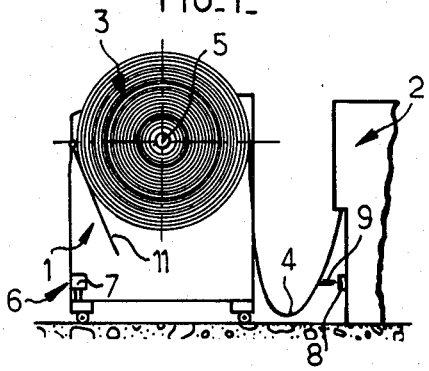
FIG. 1 is a simplified view of the elevation of an unwinding unit, with a paper-roll on a reel, intended to feed a secondary treatment and/or printing unit which is only partially shown.
Figure 2:
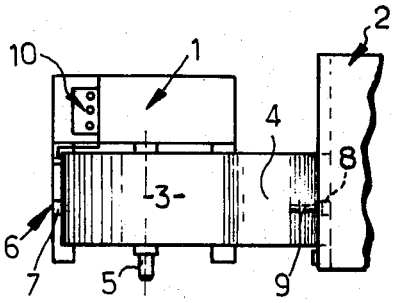
FIG. 2 is a plan view of FIG. 1.

Referring to FIGS. 1 and 2, two independent units 1, 2 are shown mounted in close proximity to each other. Unit 1 is an unwinding unit for a reel 3 which holds a roll of blank paper. This unwinding unit 1 permits the continuous movement of the paper-run from reel 3 to unit 2 which latter is intended to treat and/or print on the paper with a view to producing particular documents, which may be personalized or otherwise.

As will be clearly seen in FIG. 1, the paper-run forms a loop 4 between the two units 1 and 2. The presence of this loop 4 is important and its fluctuations are directly linked to the operation of the device controlling the rotation of the spindle 5 which carries the reel 3. In order to control these fluctuations of the loop 4, a detection and control device 6 is provided for monitoring the position of the low point formed by the loop 4 of the paper.

The device 6 consists of a photo-electric cell 7, carried by the unwinding unit. This cell is activated by a light-source 8, which for convenience is shown mounted on unit 2.

These two elements comprising cell 7 and the light-source 8 are mounted facing each other along the axis of unreeling of the paper-roll in such a way that the light-beam 9 from the source 8 can be intercepted by the paper loop 4. The cell 7 is connected to the control box 10 (FIG. 2) of the unwinding unit, which box governs particularly the speed of rotation of spindle 5 carrying reel 3. With this form of layout, when beam 9 is intercepted by loop 4, the unwinding action of reel 3 is stopped since the paper-run is now sufficiently slack between the two units to prevent any abrupt tension in the roll. On the other hand, if beam 9 is not intercepted by paper loop 4, light cell 7 (which then uninterruptedly receives light beam 9) produces an electrical signal which is interpreted as a command to control box 10 to cause spindle 5, carrying reel 3, to rotate.

As a result, this detection and control device 6 enables firstly the fluctuations of paper loop 4, formed by the paper run between the two units, to be regulated automatically, and secondly instructions to be given to unit 1 according to the requirements of unit 2.

A further provision consists of a feeler arm 11, at unwinding unit 1, which provides information about the overall diameter of reel 3. This arm 11 sends this information to control box 10 which uses this information to allow a value for the inertia of the reel to be obtained and to be taken into account when an instruction to stop is given.

Thus, the two units 1 and 2 are not in fact connected, in this case, by any mechanical link or electrical cable, the only connection between them being the paper run from roll 3.

The unwinding of the paper roll therefore occurs in response to the actual requirements of unit 2, with which the unwinding unit 1 is associated.

Figure 3:
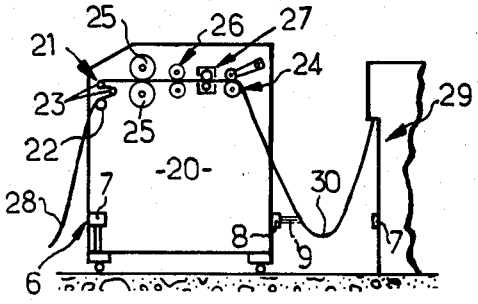
FIG. 3 is a simplified view of the elevation of a treatment unit for a paper-run, which passes across the unit from one side to the other, and which connects with another unit which is only partially shown.
Figure 4:
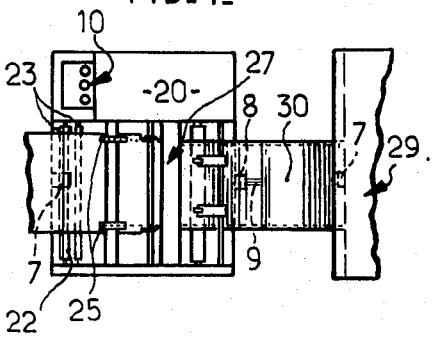
FIG. 4 is a plan view of the unit shown in FIG. 3.

FIGS. 3 and 4 show in greater detail a first example 20 of the aforementioned unit 2 which receives the paper run from the unwinding unit 1 (not shown). The unit 20 is a paper treatment unit. It consists of a system 21 to raise the paper roll at the entrance to the unit so as to tighten and guide the paper. This system 21 consists of a roller 22 and rollers 23. The rotation of roller 22 and the amount of pressure exerted on the paper by rollers 23 depend on the weight of the paper. The unit 20 also comprises, at the departure point, a system of conveyance by traction 24, which draws the paper roll across unit 20. Between these two systems 21 and 24 are located devices for treatment of the paper run, which are known in their own right, such as a perforating device of the CARROLL type, consisting of two wheels 25, an edge-trimming device 26, and finally a brushing and suction device 27, which allows the paper to be cleaned after its treatment.

The paper loop 28 formed by the paper run in advance of unit 20 is controlled by a detection and control unit which is associated with the unit located "upstream" from unit 20 and corresponding to that shown in FIGS. 1 and 2. "Downstream" from this unit 20, the paper run can be received by another treatment and/or printing unit 29, with a paper loop 30 formed between the two units 20 and 29, whose fluctuations are detected and controlled by a detection and control device 6 of the type indicated in FIGS. 1 and 2. The device 6 for loop 28 is connected to control box 10 of unit 20 so as to stop the conveyer system 24 when the low point of loop 28 fails to intercept light beam 9.

As a variant, it is possible, for example, to replace the edge-trimming device 26 by a device which inserts attachment clips, known per se, thereby permitting the production of a roll consisting of several layers proceeding respectively from several unwinding units mounted in advance of unit 20. As another variant, this device for the insertion of attachment clips can be replaced by a gluing device, with a hot or cold glue-jet.

Figure 5:
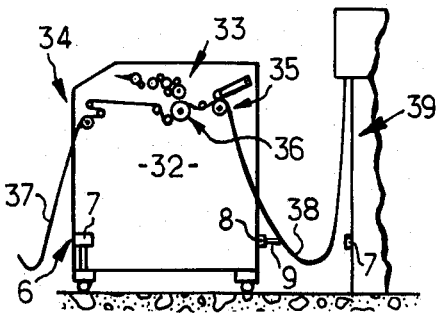
FIG. 5 is a simplified view of the elevation of another treatment and/or printing unit for a paper-run, which passes across the unit from one side to the other, and which connects with another unit which is only partially shown.
Figure 6:
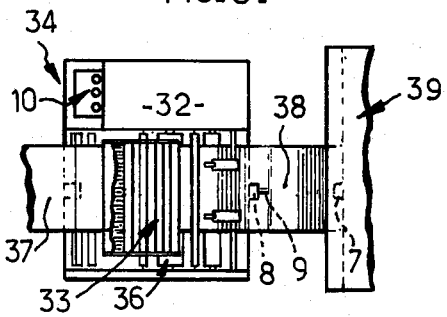
FIG. 6 is a plan view of FIG. 5.

Referring to FIGS. 5 and 6, a second form of construction 32 of the unit 2 shown in FIGS. 1 and 2, will now be described. Thus unit 32 consists, for example, of a rotary printing combination, known per se, of the typographical type. As in the previous form of construction shown in FIGS. 3 and 4, a system 34 is provided at the entry to unit 32 to tighten and guide the paper and, at its departure point is provided a traction device 35 which draws the paper through unit 32.

It would be equally possible to provide a system which permits the adjustment of the printing of the paper (from the roll) with treatment of it, if necessary, which system consists essentially of a roller 36. As mentioned earlier, fluctuations in paper loops 37 and 38, respectively "upstream" and "downstream" from unit 32 are detected and controlled by a detection and control device 6 like the one shown in FIGS. 1 and 2. On the "downstream" side unit 32 may be linked by the intervention of loop 38 to another treatment and/or printing unit.

Figure 7:
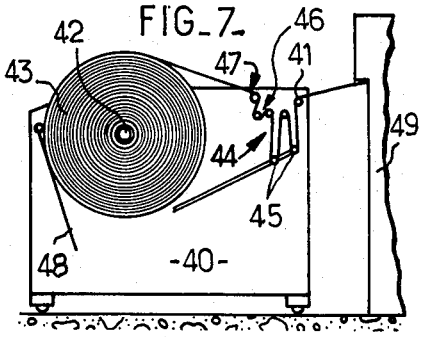
FIG. 7 is a simplified view of the elevation of a rewind unit for the paper-run coming, for example, from a treatment and/or printing unit which is only partially shown.
Figure 8:
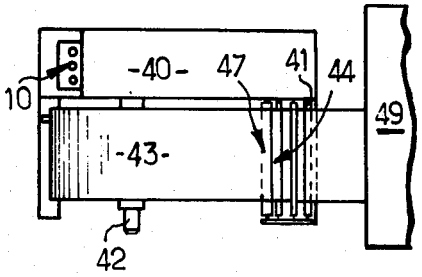
FIG. 8 is a plan view of FIG. 7.

Referring to FIGS. 7 and 8, a unit 40 which can be used at the end of the line, i.e. after treatment and/or printing of the paper, will now be described. This unit 40 has the function, of continuously rewinding the paper into a roll. Unit 40 consists of a traction device 41, and a reel-carrying spindle 42 which is subservient to traction device 41. Between conveyor system 41 and reel 43 there is a jacking system 44 with two rollers 45. This system 44, known per se, feeds the paper to roll onto winding spindle 42 and includes a movable jack (not shown) whose position is transmitted to the control box 10 of unit 40. When the jack is high up in the slot, a signal is generated which orders the reel to stop winding. When the jack is in its very lowest position in the slot, the re-wind speed of the reel is at its maximum.

On leaving the jacking system 44, the paper run passes into a system of elevating rollers 46, then on to a cylinder 47 equipped with a braking device whose degree of braking power depends on the weight of the paper. A feeler arm 48 transmits the diameter of reel 43 to control box 10, which ensures the driving of spindle 42 in accordance with the information provided by jacking system 44 and feeler arm 48. Thereby abrupt starts and stops in the process of rewinding the paper into a roll are avoided.

This unit 40 receives, for example, the paper roll which has been treated and/or printed on by unit 49.

Figure 9:
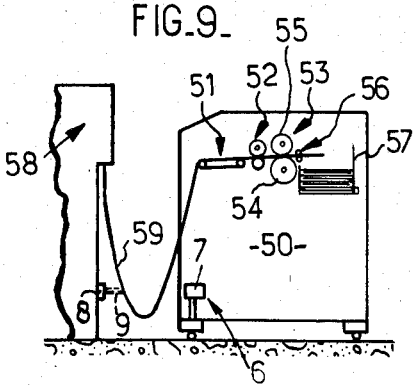
FIG. 9 is a simplified view of the elevation of a guillotining unit or rotary cutter for the paper run coming, for example, from a treatment and/or printing unit which is only partially shown.
Figure 10:
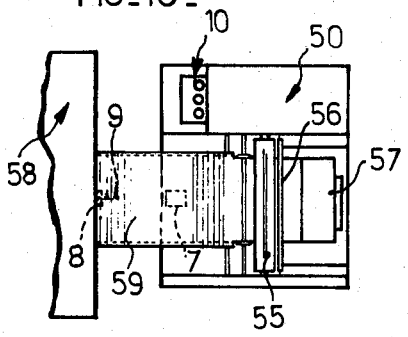
FIG. 10 is a plan view of FIG. 9.

Referring to FIGS. 9 and 10, a unit 50, which like unit 40 can be mounted at the end of the line, will now be described. This unit 50 has the essential function of cutting the paper run into sheets. Unit 50 consists of a traction device 51, followed by an edge-trimming system 52, and then by a rotary cutter 53 comprising lower and upper cylinders 54 and 55 which carry cutting blades. Once cut, the sheets next pass between two rollers 56, one above the other, and on to a collecting rack 57. It should be noted that the two rollers 56 rotate between two and three times faster than the linear speed of the paper from the roll, which speed depends on the weight of the paper.

The unit 50 receives, for example, the paper run previously treated by a unit 58 situated "upstream" from unit 50. The paper passing between the two units 50 and 58 forms a loop 59 whose fluctuations are controlled by a detection and control device 6 such as previously described. This device 6, linked to the control box 10 from unit 50, sends stop/go instructions to the conveyor system 51.

Figure 11:
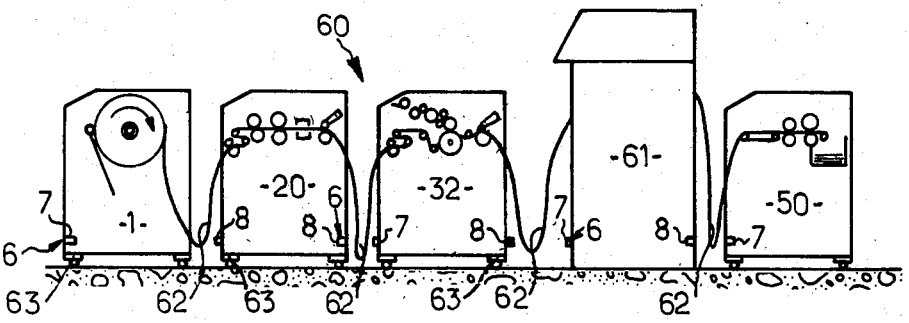
FIG. 11 represents, in simplified form, a production line for the continuous production of documents, consisting of a succession of units of the type shown in the preceding figures.

FIG. 11 illustrates one example of a continuous production line 60 for producing documents from a roll or run of blank paper. The line 60 consists of several units of the type previously described in relation to FIGS. 1 to 10.

The line 60 of FIG. 11 comprises the following, mounted one another another:

- an unwinding unit 1, such as that shown in FIGS. 1 and 2,
- a treatment unit 20, such as that shown in FIGS. 3 and 4, and producing, e.g., perforations of the "CARROLL" type,
- a printing unit 32 such as that shown in FIGS. 5 and 6,
- a printer 61 such as a computer print-out peripheral, and
- an end-of-line unit such as unit 50 shown in FIGS. 9 and 10, whose function is to cut the paper from the run into sheets, each corresponding to an individual document.

In this example the paper from the run forms a loop 62 between each two adjacent units. The fluctuations of each loop 62 are detected and controlled by a respective control device 6 of the type earlier above described, to give the loop a minimum low point.

It also should be noted that the different units, apart from the printer 61, are equipped with casters 63 which allow the units to be moved easily so as to modify the production line, if required, in accordance with what is needed. As each of these units works independently, the setting-up of the production line is an easy matter, the only thing in common between these units being the paper run which unreels from one to another.

Figure 12:
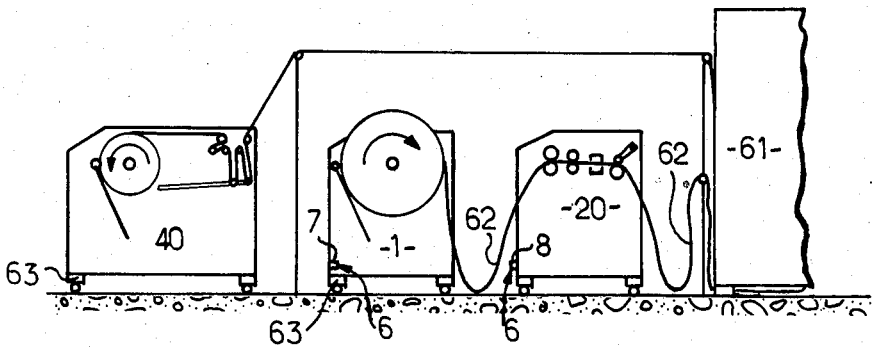
FIG. 12 represents, in simplified form, another production line for documents.

FIG. 12 illustrates another example of a production line for the production of documents, which comprises successively:

- an unwinding unit 1 for a paper roll such as that shown in FIGS. 1 and 2,
- a treatment unit 20 such as that shown in FIGS. 3 and 4,
- a printer 61 (e.g. a laser printer), and
- a re-wind unit 40 such as that shown in FIG. 7.

With this form of layout, it should be noted that the re-wind unit 40 can be situated on the same side of printer 61 as the unwinding unit 1.

As before, the fluctuations of each loop 62 of paper between each two adjacent units are detected and controlled by a detection and control device 6 (earlier above described). However, when a rewind unit 40 is used, such as that detailed in FIGS. 7 and 8, there is no loop of paper 62 between the printing device 61 and unit 40. In fact, the presence of such a loop depends on the characteristics of the respective units themselves, but it is perfectly reasonable, as in the example shown in FIG. 11, always to allow for a loop of paper between two adjacent units.

Figure 13:
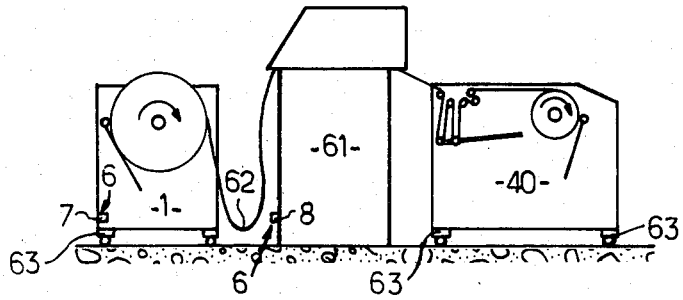
FIG. 13 represents, in simplified form, a further production line for documents.

FIG. 13 illustrates a further production line consisting of:

an unwinding unit 1, such as that shown in FIGS. 1 and 2, a printing device 61, and 1 rewind unit 40, such as that shown in FIGS. 7 and 8.

In this example it is assumed that the paper run already is treated, and this production line has the advantage of being able to operate without connection.

With the two forms of layout shown in FIGS. 12 and 13, once the paper run is rewound in unit 40, the reel subsequently can be guillotined to the desired format, with the plan thereafter to insert the forms into envelops for dispatch.

Figure 14:
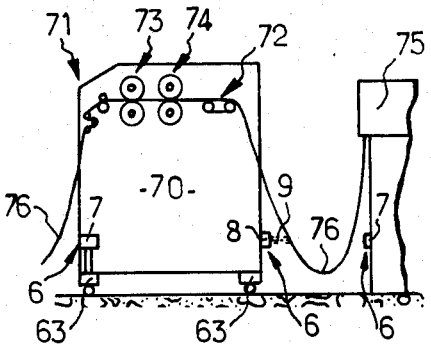
FIG. 14 is a simplified view of the elevation of a variant of a treatment unit for a paper-run, which connects with another unit which is only partially shown.
Figure 15:
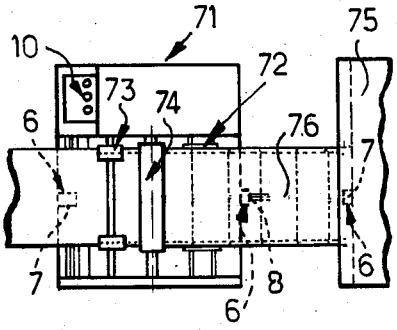
FIG. 15 is a plan view of FIG. 14.

Referring to FIGS. 14 and 15, a variant of treatment unit 20 (shown in FIGS. 3 and 4) will be described. This new treatment unit 70 incorporates at its entry point a system 71 which enables the paper run to be drawn taut and guided, and at its departure point is a traction unit 72 which serves to draw the paper along. Between these two systems 71 and 72 there is a perforating device 73 of the "CARROLL" type, and a system 74 which serves to perforate the paper transversely in a dotted line in such a way, for example, as to let the paper be folded in a zig-zag pattern. The distance between each transverse perforation varies according to the required format.

This unit is linked "upstream" with another unit (not shown), and "downstream" with another unit 75. Between each two units the paper is loped as at 76, the fluctuating portion of which is detected by a control device 6 and controlled in the same way as earlier described with other units.

Figure 16:
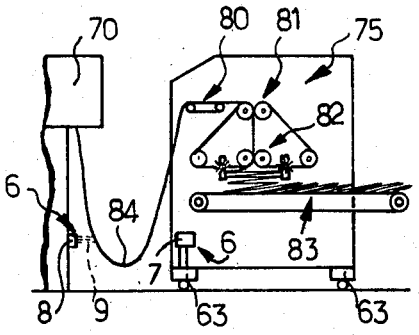
FIG. 16 is a simplified view of the elevation of a unit for folding the paper-run coming from a treatment and/or printing unit which is only partially shown.
Figure 17:
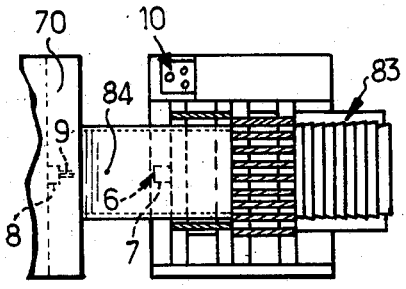
FIG. 17 is a plan view of FIG. 16.

FIGS. 16 and 17 include details of a unit 75, which can be located after unit 70 of FIGS. 14 and 15, and a printing device. Unit 75 serves the function of folding in zig-zag the paper (from the roll) which has been treated by unit 70. The paper from the run, edged with a perforation of the "CARROLL" type is drawn along by a traction unit 80 and also the drawing rollers 81. The paper run, which has been earlier perforated transversely in a dotted line by the perforating system 74 of unit 70, is folded by a combination of stops, brushes and belts 82 at the location of the transverse perforations, separated by distances which determine the format of the documents arriving on a receiving belt 83.

The unit 75 actually is a variant of the cutting unit shown in FIGS. 9 and 10.

As with the foregoing forms of construction, the paper forms a loop 84 between units 70 and 75, whose positional fluctuations are detected by a detection device 6 and controlled as previously described. These units also are equipped with casters 63 and with a location-fixing system, enabling them to be moved or immobilized respectively without difficulty.

Figure 18:
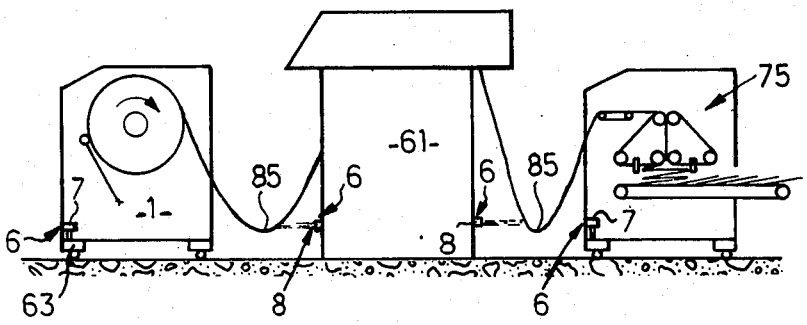
FIG. 18 represents, in simplified form, a continuous production line for the continuous production of documents, which incorporates, e.g., a computer printer.

Referring to FIG. 18, a production line for documents is shown, comprising:

an unwinding unit 1, such as that shown in FIGS. 1 and 2, a printing device 61, and a unit 75, such as that shown in FIGS. 16 and 17.

This line permits paper, which already has been treated and personalized by the printing device 61, to be folded in zig-zag pattern. Between one part of printing device 61 and another, the paper run forms a loop 85 whose positional fluctuations are detected by a detection device 6 and controlled as previously described.

The different production lines given by way of examples, of course, can be modified in accordance with the work to be carried out. The important feature is the detection and control of the positional fluctuations in the loop of paper formed between each two adjacent units.

The different units which have been described earlier above may be located before and/or after various machines such as a computer printer (of the drum, chain, laser or ink-jet type), a combination printing device (e.g. typographic, indirect, dry or wet), a cutting machine (e.g. of the guilletine or rotary type, etc.), or a postal dispatch machine, and with the direct or indirect intervention of a computer. These units have the advantage of starting direct with a blank roll coming straight from production, with the particular advantage of increasing the independence of the individual machines, and the independence of the users, as compared with conventional printers.

Furthermore, the production process according to the invention avoids the problems of handling and stocking documents obtained from conventional printing works, with, in addition, the elimination of the enormous waste of paper which occurs in a conventional print works at the beginning and end of each treatment process.

Although the various examples illustrated in the drawings are oriented towards working with paper, the applications of the invention are not restricted to this material. It is quite possible, in fact, to adapt the principle of the invention to a flexible carrier material made of plastics, fabric, fibre, sheet metal, glass, etc.

With the different described forms of layout, mention has been made of the fact that the various units are in effect linked to each other by the intermediacy of the paper run. Although it is a feature of the invention that no linking of one unit to another is required over than by the loop of paper, the invention may be applied equally to a production line in which two or more of the separate processing stages are linked together other than just by the paper loop, e.g. mechanically and/or electrically or with a computer or printing machine, etc., without thereby altering the spirit of the invention.

It should be noted also that the device which detects the fluctuations of the loop of paper between two adjacent units can comprise a system other than one based on a light source and photo-electric cell, such as an infra-red beam or air-jet system, etc.

The invention is, of course, in no way restricted to the forms of construction which have been described and given only by way of example, but includes all those technical equivalents of the methods described, together with combinations of the same, if these are effected and operated within the scope of the appended claims.

What is claimed is:

1. A modular system for continuously producing business forms printed on a high-speed computer printer from a blank roll of paper comprising:

an independent first modular unit having means for supporting and controllably unwinding the roll of paper at a variable speed, an independent second modular high-speed printing unit aligned with said first modular unit, said second modular unit being mechanically independent from said first modular unit and having means for accepting said paper, means for printing on said paper, and means for controllably pulling said paper through said second modular unit as it is required, said paper forming a first loop extending between said first and second modular units, first means for monitoring the position of the bottom of said first loop, and control means responsive to said said first monitoring means for causing said unwinding means to govern the speed of unwinding of said roll so that the roll is unwound whenever the first monitoring means senses that the bottom of said first loop moves above a predetermined level, whereby in response to the requirements of said second modular unit, said roll is unwound only by said unwinding means.

2. The modular system of claim 1 wherein said first monitoring means includes a photosensitive cell positioned on one of said first and second modular units and a light emitting element positioned on the other of said units, said elements being aligned with one another and being positioned on opposite sides of said first loop.

3. The modular system of claim 1 further comprising:

an independent third modular unit aligned with said second modular unit, said third modular unit being mechanically independent from said second modular unit and having means for accepting said material, means for processing said material toward a finished form, and means for controllably pulling said material through said third modular unit, said web forming a second loop extending between said second and third units, second means for monitoring the the portions of said second loop, and second control means responsive to said second monitoring means for causing said pulling means to control the rate of supply of material from the second unit to the third unit.

4. The modular system of claim 3 further comprising:

an independent final modular unit aligned with said third modular unit, said final modular unit being mechanically independent from said third modular unit and having means for accepting said material, means for processing said material into its finished form, and means for controllably pulling said material through said final modular unit as it is outputted from said third modular unit.

5. The modular system of claim 4 wherein said processing means of said final modular unit includes means for folding said material into a zig-zag pattern.

6. The modular system of claim 4 wherein said processing means of said final modular unit includes means for cutting the material into sheets.

7. The modular system of claim 4 wherein said final processing unit includes a rotatable reel, means for selectively winding said reel, input sensing means for sensing the amount of material being fed from said third modular unit to said final modular unit to develop an input control signal, diameter sensor means for sensing the diameter of the roll of finished material to develop a diameter signal, and control means responsive to said input signal and said diameter signal for causing said winding means to wind the material onto the reel as it is outputted from said third modular unit.

8. The modular system of claim 3 wherein said processing means of said third modular unit includes means for changing the physical structure of said roll.

9. A modular system for continuously producing business forms printed on a high-speed printer from a blank roll of paper comprising:

an independent first modular unit having means for supporting and controllably unwinding the roll of paper at a variable speed and a feeler arm for sensing the diameter of the roll of paper;

an independent high-speed printing unit aligned with said first modular unit, said high-speed printing unit being mechanically independent from said first modular unit and having means for accepting, tightening and guiding said paper, means for printing on said paper, and traction means for controllably pulling said paper through the printing means as it is required, said paper forming a loop extending between said first modular unit and said high-speed printing unit, means for monitoring the position of the bottom of said loop, said means including a photosensitive cell positioned on one of said first and second modular units and a light emitting element positioned on the other of said units, said elements being aligned with each other and being positioned on opposite sides of said first loop; and control means responsive to the diameter of the roll sensed by the feeler arm and to said first monitoring means for causing said unwinding means to govern the speed of unwinding of said roll so that the roll is unwound whenever the monitoring means senses that the bottom of said first loop moves above a predetermined level, whereby said roll is unwound in response to the needs of the high-speed printer but only by said unwinding means.

10. An installation for the continuous treatment of a web of paper, comprising an unwinding unit for receiving and holding a web of paper wound into a roll, and comprising drive means for causing unwinding of the web from the roll; an independent second unit located in the immediate proximity of the unwinding unit for receiving the web of paper from the latter and for processing of the paper, the arrangement being such that, in use, the web can form a freely hanging loop between said unwinding unit and said second unit; and control means associated with the unwinding unit to the second unit, comprising means for detecting and monitoring the position of the lowest point of a freely hanging loop of paper between the unwinding unit and the second unit and for controlling the drive means in response to the height of said lowest point in dependence of the requirement of the second unit such that, in use, the paper is always in a slack and variable configuration between said roll and said second unit.

* * * * *